United States Patent [19]

Lövqvist

[11] 4,077,563

[45] Mar. 7, 1978

[54] COLLECTING DEVICE FOR REFUSE, DUST ETCETERA

[76] Inventor: Karl Bo Lennart Lövqvist, Nyvallsvagen 13, 802 39 Gavle, Sweden

[21] Appl. No.: 712,864

[22] Filed: Aug. 9, 1976

Related U.S. Application Data

[63] Continuation of Ser. No. 461,130, Apr. 15, 1974, which is a continuation of Ser. No. 222,866, Feb. 2, 1972, abandoned.

[30] Foreign Application Priority Data

Feb. 17, 1971 Sweden ..... 2026/71

[51] Int. Cl.[2] ..... B65D 91/00

[52] U.S. Cl. ..... 232/43.2; 248/97

[58] Field of Search ..... 232/43.2, 43.3, 43.4, 232/43.5, 30, 53, 1 R; 248/95-101; 206/16.5, 63.2; 229/14 B, 14 BE

[56] References Cited

U.S. PATENT DOCUMENTS

| | | | |
|---|---|---|---|
| 341,545 | 5/1886 | Barnes et al. | 248/99 X |
| 917,126 | 4/1909 | Pilkington et al. | 232/53 |
| 1,640,888 | 8/1927 | Davis | 232/28 |
| 1,909,670 | 5/1933 | Evans | 248/97 X |
| 2,319,384 | 5/1943 | Callan et al. | 220/65 |
| 2,726,035 | 12/1955 | Meissner | 232/43.1 |
| 2,768,783 | 10/1956 | Arzig | 232/53 X |
| 3,321,130 | 5/1967 | Cleghorn | 232/43.2 |
| 3,370,787 | 2/1968 | Lindholm et al. | 232/43.2 |
| 3,529,766 | 9/1970 | Mott, Sr. et al. | 248/99 X |

FOREIGN PATENT DOCUMENTS

| | | | |
|---|---|---|---|
| 251,491 | 1/1967 | Austria | 248/95 |
| 519,332 | 10/1953 | Belgium | 232/43.1 |
| 1,920,978 | 5/1970 | Germany | 232/43.2 |
| 212,557 | 4/1967 | Sweden | 248/97 |
| 214,997 | 8/1967 | Sweden | 248/98 |

*Primary Examiner*—Ramon S. Britts
*Assistant Examiner*—Peter A. Aschenbrenner
*Attorney, Agent, or Firm*—Stevens, Davis, Miller & Mosher

[57] ABSTRACT

A refuse collector including a casing for a receptacle and a holder for a magazine of hose-shaped material in which the holder is movably mounted in relation to a support. The hose-shaped material is drawn from the holder into the casing to form a receptacle. The holder may be moved in relation to the support so as to enable a filled receptacle to drop out of the bottom of the casing. When the filled receptacle is discarded, the material stored in the holder is drawn into the casing and is ready to receive more refuse. In one embodiment, the holder is pivotally mounted to the support while in a second embodiment the holder may be moved vertically with respect to the support.

6 Claims, 5 Drawing Figures

COLLECTING DEVICE FOR REFUSE, DUST ETCETERA

This is a continuation of application Ser. No. 461,130 filed Apr. 15, 1974 which in turn is a continuation of application Ser. No. 222,866 filed Feb. 2, 1972.

The present invention relates to a collecting device for refuse, dust etcetera.

One object of the invention is to provide a collecting device in which the receptacle for the refuse etc. is produced from a long, hose-shaped packaging material and in which several bags can be produced consecutively by drawing a sufficient length of packaging material from a magazine or storage of such material.

Another object of the invention is to provide a collecting device comprising a casing or other protecting structue for the receptacle and/or the magazine, said casing or at least part thereof being shiftable from a first position in which the collecting device is used for receiving refuse etc, to a second position for providing a sufficient passage or space for the removal of the filled receptacle from the collecting device.

Preferably the magazine is ring-shaped, surrounding a passage through which the refuse etc. is thrown into the receptacle. In such a magazine the packaging material which is preferably a plastic e.g. polyethylene, film is folded together with the folds extending in the circumferential direction of the hose. The magazine may be provided at the exterior of said casing or within the casing, which is preferably pivotally mounted on a supporting structure therefor.

The invention will be described in detail hereinafter with reference to the accompanying drawings which illustrate two embodiments of the collecting device according to the invention. In the drawings.

Figure 1:
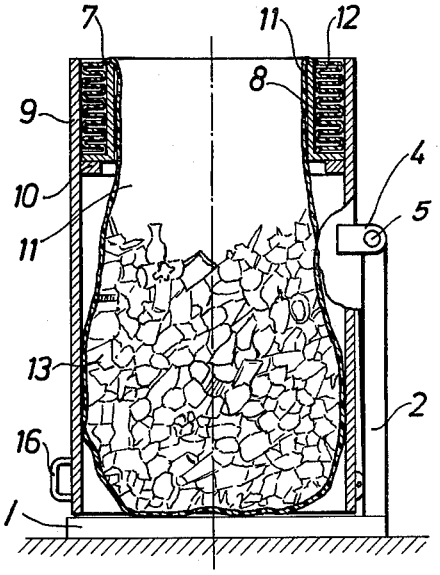
FIG. 1 is a side elevational view, partly in section and partly broken away, of a refuse bin or collector according to one embodiment and with the refuse bin casing in its normal position.

Referring now to the drawings, numeral 1 designates a base plate for carrying the refuse bin and forming, together with two vertical columns 2 mounted on the base plate, a supporting structure or frame for the refuse bin. The refuse bin includes a casing 3 which may be cylindrical, e.g. circularly cylindrical, in shape. The casing, alternatively, could be conically tapering in an upward direction, or have any suitable other shape. The casing is made of a rigid material and may consist, for instance, of sheet-metal, plastic material, wire netting or the like. The casing is open at both top and bottom ends.

The casing is provided with projecting brackets 4 by which the casing is pivoted to the columns 2 by a shaft 5 passed through aligned holes 6 formed in the brackets 4.

Disposed within the top portion of the casing is a storage or magazine of a hose-shaped flexible packaging material such as a plastic-sheet material in an annularly collapsed or folded condition with the folds extending circumferentially of the hose. The hose-shaped material is designated by 11 and the magazine by 12. The hose-material storage is accomodated in a cylindrical space between the inner wall surface of the casing and a tubular member 7 comprising a cylindrical body portion 8 and a horizontal flange portion 9, the latter being supported on a plurality of studs 10 mounted on the inner wall surface of the casing. From the hose-material magazine 12, the hose material 11 is extended across the top edge of the tubular member 7 and downward into the casing 3 within which the hose-shaped sheet-material will form a receptable or bag for receiving refuse. The bag is supported by the inner wall surfaces of casing 3 and, as also seen in FIG. 1, there is normally an air-filled space between the casing and the bag, this space being adapted to serve as a heat insulation to prevent the bag and its contents from becoming excessively heated, e.g. when the casing is exposed to intense radiant solar heat.

In the drawing, the refuse is designated by 13, and it may be pointed out in this connection that, owing to the support afforded by the inner wall surface of casing 3, the plastic-sheet refuse bag will stand even sharp-edged objects, such as thin cans, plastic bottles etc., thrown down into the same, without tearing.

Figure 3:
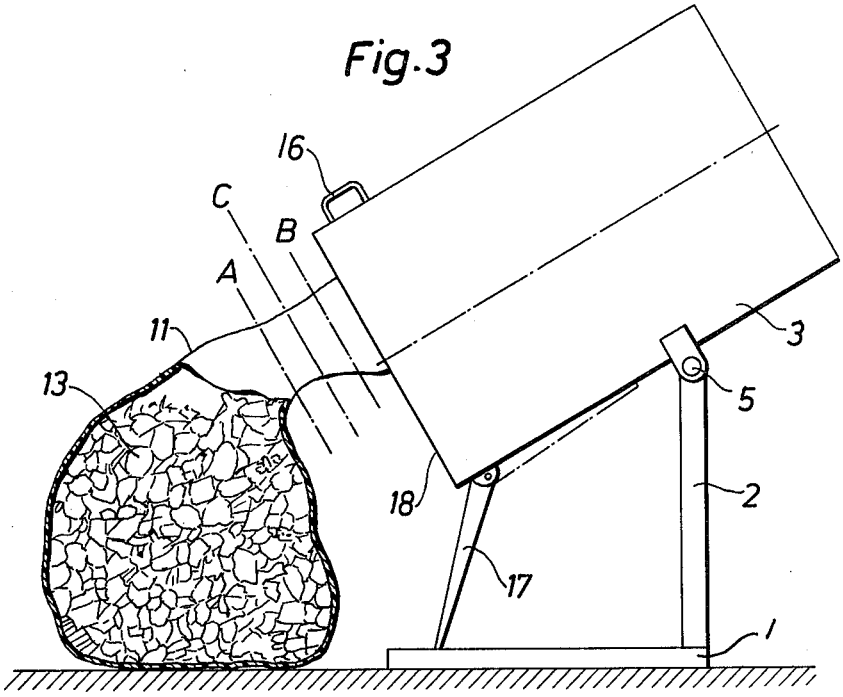
FIG. 3 is a side elevational view similar to that according to FIG. 1, but with the refuse bin casing pivoted into an upper position to facilitate removal of the refuse receptacle or bag from within the refuse bin casing.

A handle 16 is mounted on the bottom end portion of the casing for facilitating pivoting the casing into an upper position in which the same is inclined relative to its normal position shown in FIG. 1. FIG. 3 illustrates the casing when pivoted into such upper or inclined position. The pivoting of the casing into its upper position as shown will facilitate removal of the filled refuse bag from within the casing. In response to such removal, a fresh length of hose material will automatically be pulled out from within the storage 12 to form a new refuse bag. After removal of the filled refuse bag, the hose material is cut off, for instance at the line designated by C in FIG. 3, after which, if desired, the refuse bag may be closed at the line designated by A, and the hose-material length intended to form the new refuse bag is closed, for instance at the line designated by B. The closure of the refuse bag and the extended hose material length can most suitably be carried out by tieing knots, plastic tapes or clamps or the like.

As seen in the drawing, the shaft 5 about which the casing 3 is pivoted is so disposed that, when swinging the casing upwardly, its bottom end, at every point thereof, will move more or less in an upward direction. This will enable the bottom edge of the casing in its normal position to closely engage the base plate 1 of the supporting frame, thereby preventing the refuse bag disposed with the casing from being accessible from outside, e.g. by rats or other vermin.

Designated by 17 is a supporting leg for retaining the casing in its upwardly pivoted position. The pivot of the casing may also be placed at such a position that the casing remains in its latter position by gravity action.

The refuse bin shown in the drawing would suitably be provided with a cover, not shown, which may be detachable or hinged to the casing 3 in a conventional manner.

The hose-shaped plastic-sheet material 11 to form the refuse containers or bags may suitable be made of polyethylene which will not leave any harmful residues or gases when burnt.

In the drawing, the magazine or storage 12 is mounted inside the casing 3, but, obviously, the magazine 12 could be mounted outside the casing, as well.

Figure 4:
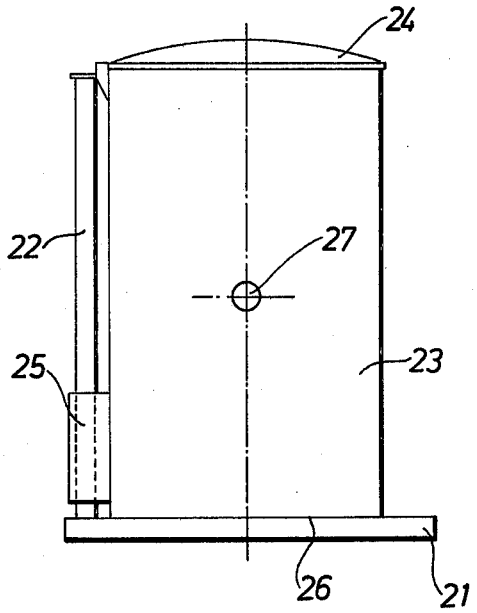
FIGS. 4 and 5 illustrate a further embodiment of the device in its normal position and in its position for facilitating removal of the refuse bag from within the casing.
Figure 5:
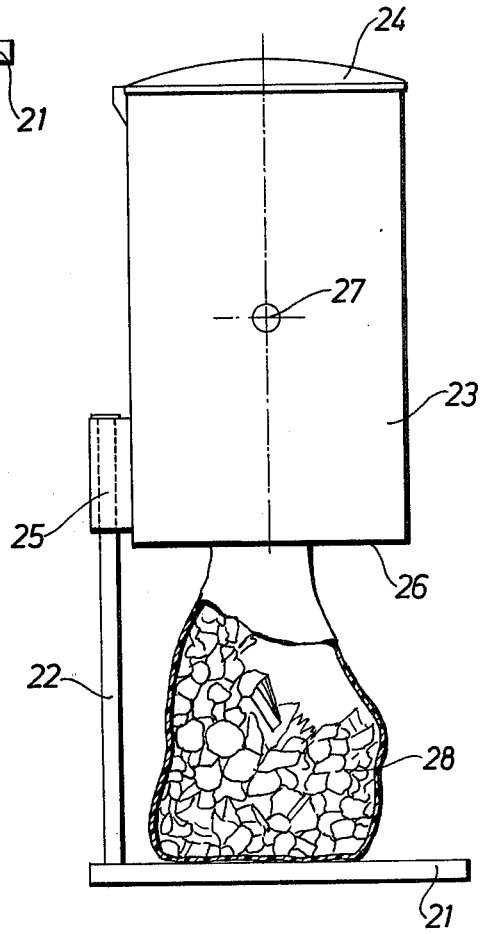

The embodiment of FIGS. 4 and 5 comprises a base plate 21 and a vertical column 22 mounted on this plate.

Figure 2:
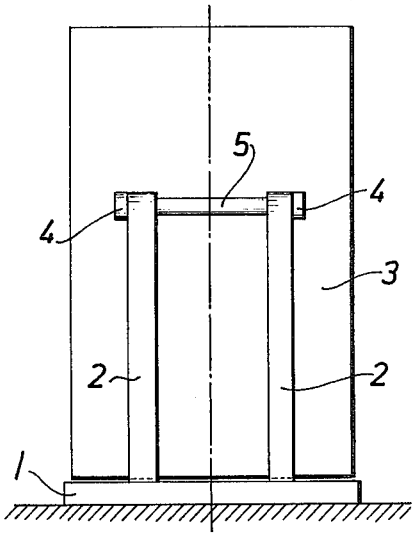
FIG. 2 is a rear elevational view of the refuse bin.

The refuse bin casing 23 having within its top portion 24 a storage or magazine for hose-shaped plastic material as described in connection with the embodiment of FIGS. 1 to 3, is provided at its bottom portion with a bracket member 25 having a hole fitting the column 22, whereby the casing 23 is displaceable along the column. In its normal position according to FIG. 4, the casing 23 occupies a lower position having its bottom edge 26, defining the bottom opening of the casing, closely adjacent to the base plate 21. FIG. 5 shows how the casing has been shifted by being displaced upward, thereby spacing the casing opening defined by the bottom edge 26 from the base plate 21, so that the bag 28 is easily accessible for removal thereof from within the refuse bin. The operations of raising the casing and of lowering the same after removal of the refuse bin are facilitated by handles 27.

The invention is not restricted to the embodiments here shown, since these are susceptible of various variations and modifications within the scope of the invention.

Thus, where the refuse collecting device is to be placed in a special protecting room therefor or the refuse receptacle can be left unprotected for other reasons the casing may be omitted or the height thereof so as to cover only the magazine. Though, according to the shown embodiments, the casing of the collecting device is shiftable in its entirety if is to be understood that this is not always necessary, since it may be sufficient if part of the casing, for instance the lower part thereof situated below the magazine is shiftable in the manner stated.

The supporting structure for the film magazine holder means may be a frame supported from the ground as shown in the drawings but may also be in the form of a bracket or the like secured to a wall, pole etc.

The thickness of the plastic film to be preferably used in the device according to the invention can be less than the wall thickness of ordinary plastic bags for the same purpose mainly since the receptacle is not suspended at its upper edge and since the knots provided on the hose-shaped material make possible an even distribution of stressing forces in the film. Moreover, where a receptacle protecting casing is provided this will lessen the requirements as to the film thickness.

The collecting device according to the invention can be used for many different products, primarily for refuse of all types in private houses in the community and in the industry, but also for other products and articles of different types for which the collecting device according to the invention can serve as a temporary container or storage means.

What I claim is:

1. Apparatus for collecting refuse in a receptacle, comprising:

a stationary support having a horizontal surface for supporting said receptacle, a substantially tubular casing open at both ends and extending substantially vertically with the lower end of said casing situated in close proximity above said horizontal surface in a refuse collecting position of said casing to prevent access to the interior thereof, a holder located at the upper end portion of said tubular casing and including a substantially annular wall spaced apart from said casing to define therebetween a substantially annular opening, a magazine of a hose-shaped plastic sheet packaging material folded together with the folds extending about said annular wall of said holder, said magazine being accommodated in said annular opening, a part of said packaging material being withdrawable from said magazine into said casing to form a receptacle for receiving refuse through the upper opening of said casing, and means, permanently and pivotally interconnecting said casing and support, for allowing said casing to move in relation to said support so as to enable removal of a filled receptacle through the lower opening of said casing, said means allowing said casing to move to an inclined position in relation to said support to facilitate removal of the filled receptacle and carrying said casing in such a way that upon shifting said casing to an inclined position in relation to said support the lower end of said casing at every point moves in an upward direction.

2. Apparatus as claimed in claim 1 wherein said plastic sheet is made of polyethylene.

3. Apparatus as claimed in claim 1 wherein said casing is cylindrical in shape.

4. Apparatus as claimed in claim 1 wherein said casing further comprises a handle at the lower end portion of said casing for facilitating movement of said casing in relation to said support.

5. Apparatus as claimed in claim 1 further comprising means for securing said casing after said casing is moved in relation to said support.

6. Apparatus for collecting refuse in a receptacle, comprising:

a stationary support having a horizontal surface for supporting said receptacle, a substantially tubular casing open at both ends and extending substantially vertically with the lower end of said casing situated in close proximity above said horizontal surface in a refuse collecting position of said casing to prevent access to the interior thereof, a holder located at the upper end portion of said tubular casing and including a substantially annular wall spaced apart from said casing to define therebetween a substantially annular opening, a magazine of a hose-shaped plastic sheet packaging material folded together with the folds extending about said annular wall of said holder, said magazine being accommodated in said annular opening, a part of said packaging material being withdrawable from said magazine into said casing to form a receptacle for receiving refuse through the upper opening of said casing, and means, permanently and pivotally interconnecting said casing and support, for allowing said casing to move in relation to said support so as to enable removal of a filled receptacle through the lower opening of said casing, said means allowing said casing to move to an inclined position in relation to said support to facilitate removal of the filled receptacle.

* * * * *